United States Patent [19]

Bruce et al.

[11] 4,182,302

[45] Jan. 8, 1980

[54] WOOD BURNING STOVE

[75] Inventors: Ray F. Bruce, P.O. Box 293, Tahoe Vista, Calif. 95732; William W. Byrd, Jr., Wilseyville, Calif.

[73] Assignee: Ray F. Bruce, Incline Village, Nev.

[21] Appl. No.: 779,331

[22] Filed: Mar. 21, 1977

[51] Int. Cl.[2] ..... F24B 1/08

[52] U.S. Cl. ..... 126/4; 126/83; 126/312

[58] Field of Search ..... 126/4, 83, 144, 312

[56] References Cited

U.S. PATENT DOCUMENTS

| | | | |
|---|---|---|---|
| 265,802 | 10/1882 | Heckel | 126/67 |
| 2,276,728 | 3/1942 | Johnson et al. | 126/285 R |
| 4,027,649 | 6/1977 | Jackson | 126/4 |

FOREIGN PATENT DOCUMENTS

| | | | |
|---|---|---|---|
| 165306 | 9/1954 | Australia | 126/4 |
| 2508485 | 9/1976 | Fed. Rep. of Germany | 126/1 AE |

*Primary Examiner*—Martin P. Schwadron
*Assistant Examiner*—Richard Gerard
*Attorney, Agent, or Firm*—Herbert C. Schulze

[57] ABSTRACT

This is a stove primarily for the burning of wood, but also capable of burning other combustible materials, which stove is characterized by a unique combustion chamber, together with a recirculating combustion chamber and baffle for more perfect combustion and characterized by a heat radiating chamber which may be closed so as to be used as an oven, and by a unique damper placement in combination with the exhaust flue pipe so adapted as to automatically activate in order to cool the flue pipe in the event it should exceed safe heat limits.

3 Claims, 4 Drawing Figures

FIG. 1
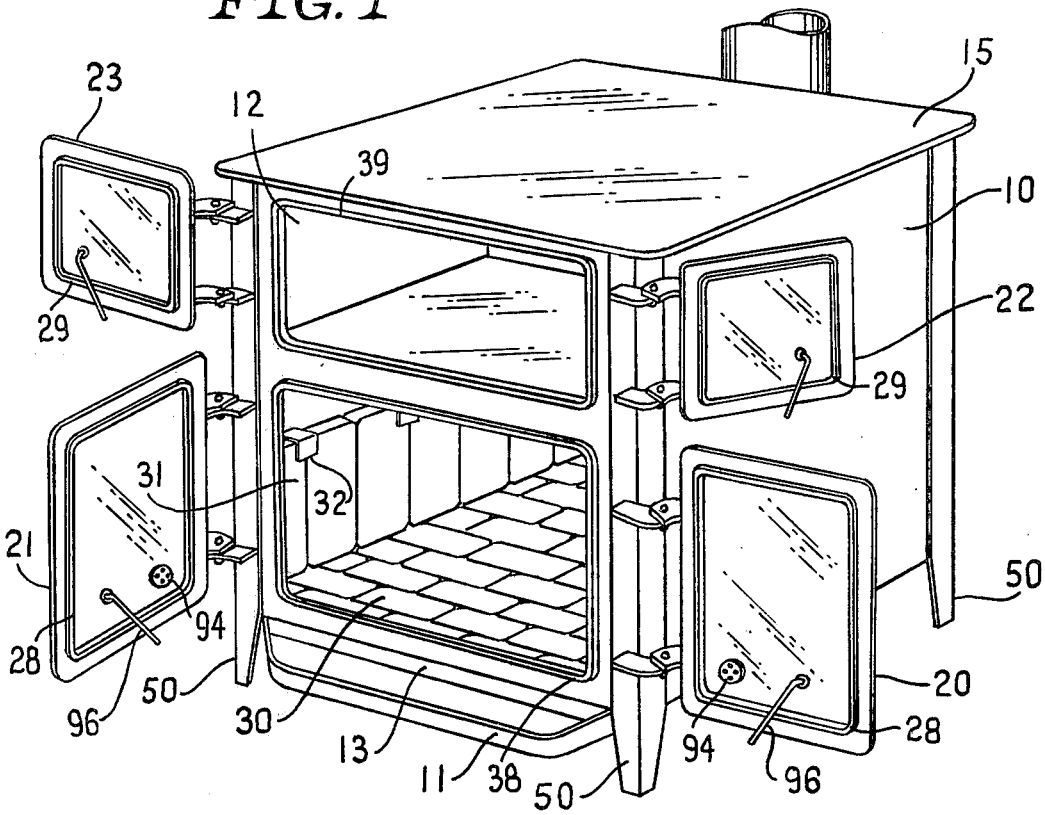
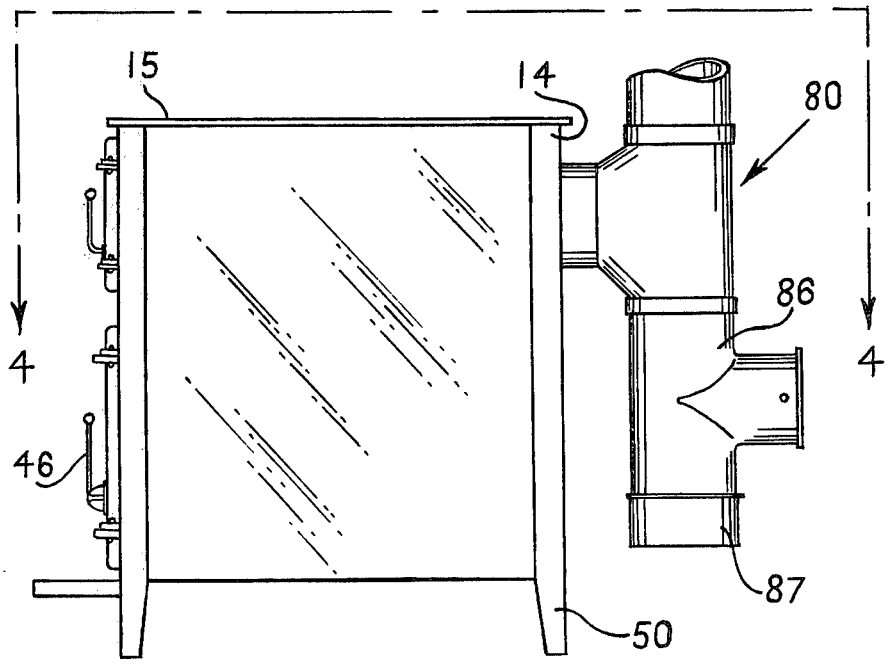
FIG. 2

WOOD BURNING STOVE

CROSS REFERENCE TO RELATED PATENT APPLICATIONS

This application is not related to any other patent application filed by us.

BACKGROUND OF THE INVENTION

1. Field of the Invention

This invention is in the general field of stoves, and is more particularly directed to a wood and trash burning stove, and is particularly directed to an improved wood burning stove of high efficiency wherein a supplementary combustion chamber for burning the gases from the wood is provided with special effective baffle arrangement to create maximum combustion and extraction of heat, and is further directed to such a stove wherein a radiating chamber is provided which may be used for oven cooking purposes, and wherein control arrangements are provided for controlling the amount of air utilized in the combustion process with cooperative damper means located in the lower portion of the flue pipe so as to provide for access of cool air when required to maintain the flue pipe at a safe temperature level.

2. Description of the Prior Art

Woodburning stoves have been known for great periods of time and there have been many different models in the past. The number of such stoves is far too great to list in the prior art, but, it is sufficient to point out that there are very few stoves utilizing what amounts to a supplemental combustion chamber for the combustion of gases and the like from wood.

None of the stoves utilizing a supplemental combustion chamber have provided for an effective baffle arrangement to maximize the supplimental combustion and transfer of heat.

Additionally, none of these stoves have utilized a cavity within the stove which cavity radiates heat and is also capable of being used for the supplemental purpose of baking, as an oven, by closing a door on its opening.

Further, none of the stoves known to this time, have ever utilized a barometric damper beneath the flue intake and connected thereto in such manner that it will cool the flue pipe in the event the flue pipe is too warm. In the sense of these unique features there is not prior art comparable to the present combination.

SUMMARY OF THE INVENTION

Woodburning stoves have been used for many years in the past and prior to the advent of gas, oil, and the like, were a predominate heating and cooking device. In recent years, particularly in the United States, the use of wood burning stoves declined due to the accessability of gas, oil, and the like.

With shortages occurring, however, in petroleum products and the like, new efforts have been directed toward wood stoves and there have been some developments by others which are worthy of note.

One of the important features of the prior art is the supplemental combustion chamber wherein gases eminating from wood being burned in the stove proper may be effectively burned creating additional heat. Further, such a stove is essentially air tight with finely adjustable air inlets so as to control combustion rate.

In all of the stoves so developed recently, however, there are still some major faults, one of the major faults being the inability to meet building code standards in many instances due to excessive heat created from the excessively hot gases which escape from the flue pipe. Temperatures of 2000 degrees and more can exist in these pipes and can exist at that point where such pipe exits through a wall or roof of a building.

Additionally, it is found that some of the excessive heat leaving through the flue pipe is due to the failure to achieve perfect radiation of the heat available to the stove itself.

After a considerable period of study and development, we have now conceived and actually developed a stove for burning wood or the like which produces superior amounts of heat from the same amount of wood to be used within the vicinity of the stove, and at the same time reduces the amount of heat being lost in combustion gases. We have accomplished this partially by the utilization of an open chamber above the main combustion area of the stove and depending from the secondary combustion area in which the gases and the like are expended.

Additionally, we have provided a baffle within the secondary combustion area which baffle allows for a more effective heat transfer and recirculating of the heated gases.

By utilizing the chamber as above set forth, we are able to achieve more efficient transfer of the heat available from the burning wood and, thus extract more of the heat available, than has heretofore been possible.

Further, we have studied the problem of excessive heat and at such times as the stove of this invention might be operated without sufficient care being paid to the ultimate heat, wherein the flue pipe might become overheated, a barometric damper is provided in an unusual location beneath the flue intake from the stove in such manner that when heat is building up the damper opens to allow cool air to enter the flue pipe thus automatically reducing the temperature and preventing overheating and thus complying with building codes and safety requirements.

As a last refinement, we have added a closable door arrangement on the radiating chamber so that if desired it may be closed and utilized as a cooking compartment, such as an oven.

It is an object of this invention to provide a wood burning stove, having superior combustion ability;

Another objection of this invention is to provide a wood burning stove with a supplemental combustion chamber provided with baffles to achieve maximum combustion of the gases resulting from the combustion and heating process;

Another object of this invention is to provide a wood burning stove as described wherein a special heat radiating chamber is incorporated for maximum transfer of heat into the area to be heated;

Another object of this invention is to provide a wood burning stove as heretofore described wherein a specially combined barometric damper is incorporated beneath the flue intake from the stove in such manner that cool air enters the cool the flue pipe when required by excessive heat in the flue pipe.

The foregoing and other objects and advantages of this invention will become apparent to those skilled in the art upon reading the foregoing description of a preferred embodiment in conjunction with a review of the appended drawings.

BRIEF DESCRIPTION OF THE DRAWINGS

FIG. 1 is a perspective of a preferred embodiment of the stove of this invention;

FIG. 2 is a side elevation of the stove of FIG. 1;

DESCRIPTION OF A PREFERRED EMBODIMENT

Figure 3:
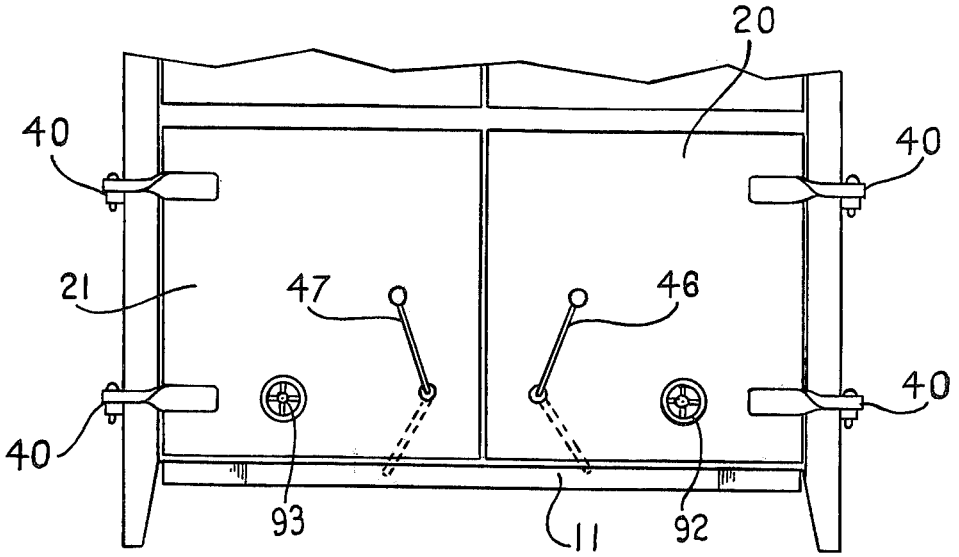
FIG. 3 is a partial front elevation of the stove of FIG. 1, but with the doors closed.

The stove of this invention is generally illustrated from the exterior in FIGS. 1, 2 and 3. It does require a review of all four figures to have a complete understanding of all of the features.

Examining FIG. 1, it is seen that the stove comprises a top plate 15 of steel or the like, preferrably welded to three side plates of steel or the like 10, 12 and 18. (Plate 18 is shown best in FIG. 4.) A bottom plate of steel or the like 13 is welded to the foregoing sides and back. Four corner angles or the like 14, having extensions 50 serving as feet, are preferably provided as illustrated. Doors 20, 21, 22 and 23 will be appropriately fastened to the front corner elements 14 by hinges or the like 25, as will be understood by those skilled in the art. These doors will preferably have some type of mating, tracks or otherwise formed interlocking ridges 28 and 29 to form as nearly as possible an air-tight seal when the doors are closed. The front plate 27 will be cast with the appropriate interlocking ridges or the like 38 and 39, or may be a plate with suitable devices welded thereon, and, of course, with the appropriate openings.

Figure 4:
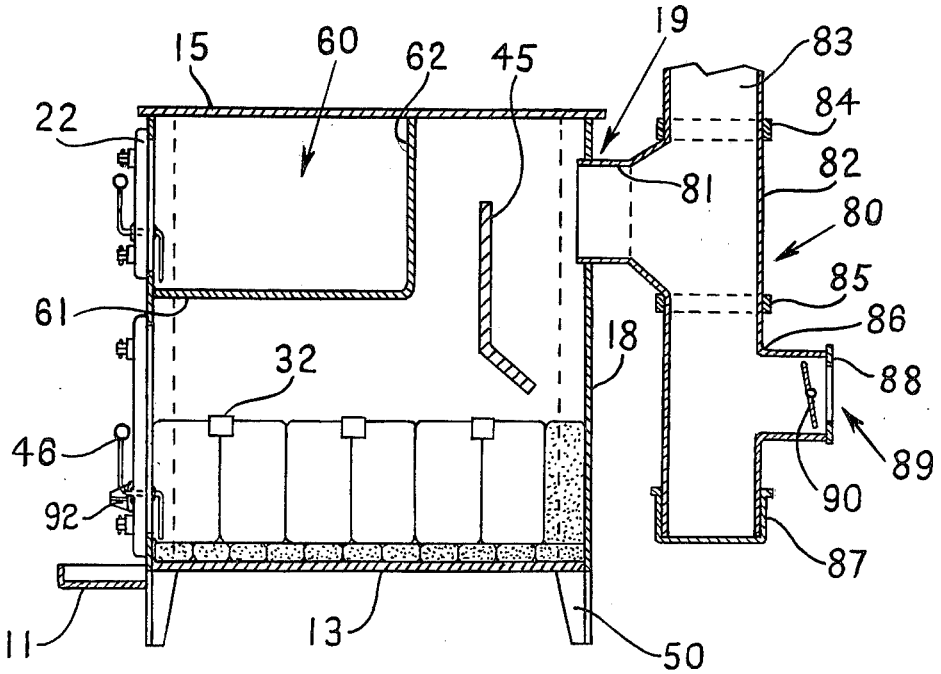
FIG. 4 is a section on 4—4 of FIG. 2.

The floor will be appropriately lined with firebrick or the like 30, and, additionally, there will be firebrick or the like 31 around the lower portion of the three sides 12, 18 and 10, as can be viewed. The firebrick 30 may be merely set in place, and the firebrick 31 will be held in place by appropriate brackets 32 spaced as indicated in FIGS. 1 and 4 for easy removal of the firebrick and replacement thereof, if desired. Air intakes 94 comprise a series of small holes in each of the lower doors, and adjustable screw caps 92 will be described in connection with FIG. 3.

Handles 46 (see FIGS. 2 and 3) will be attached through a bearing position through the doors approximately as shown, by means known to those skilled in the art, which handles will activate a latching bar 96 on each of the doors, which latching bar will appropriately latch on the edges of the front plate 17 as particularly shown in FIG. 4. By this means of latching, known in the art, the doors may be fastened securely.

The outstanding ledge 11 will provide a space to catch ashes and the like from the interior of the stove when the doors are opened.

There will be a flue 81 connected to an opening at 99 in the back plate 18. This flue enters a "T"-type flue fitting 82 connected to flue pipe 83 onto another "T"-type fitting 86 by appropriate coupling rings 84 and 85, or the like. The lower "T", 86, is provided with an end cap 88, as shown, having an opening 89, and a barometric damper 90 mounted according to customary means.

Removable cap 87 is connected to the bottom of the "T" 86 as shown.

The air adjustment caps 92 comprise essentially a disc having a threaded hole in the center, which threaded hole mounts upon a bolt or the like 93. By screwing the plate 92 further in towards the door 20, the amount of air accessable to holes 94 is reduced, thus controlling the amount of air entering the combustion chambers and thus controlling the fire.

The oven compartment 60 is shown particularly well in FIG. 4 and comprises plates 62 and 61 welded to the top 15 and the two sides 10 and 12. It may also be welded to the front plate 17.

A baffle is positioned as at 45, comprising a plate bent in the approximate angular relationship shown and welded to the two sides 10 and 12. This provides a supplemental circulating or secondary chamber for total combustion of the gases, and for proper heating of the plates 61 and 62, thus allowing for maximum radiation of heat into the chamber 60 and out into the area to be heated if the doors 22 and 23 are left open.

The result of the proper adjustment of the air cap 92, combined with the features otherwise shown and previously described, allows for the easy and effective achieving of heat utilization from wood or other matter being burned.

Some of the unusual features include the spacing of the brick groups 32 in the manner as shown so that they are held in position, but so held as to allow easy removal of individual bricks and replacement, as desired. The bricks will normally have sufficient space between them to allow for the slipping out of one brick next to another.

In the event heat becomes excessive in exiting from the stove and up to the flue, the barometric damper 90 automatically opens and allows sufficient cool air to circulate with the heated air so as to maintain an appropriate heat within the flue so as not to be excessively heated and thus create danger and violate building codes. The location of this damper beneath the flue intake from the stove is critical to this operation and comprises a portion of the invention.

As previously described, the baffle, being located in the supplemental combustion chamber, which comprises that portion of the stove which is to the rear of and adjacent the oven portion, is also a very important part of the invention, and the clean-out arrangement at 87 is new and unique, as is the protruding tray 11.

In the illustrations, there have been shown some doors on the combustion chamber itself as well as the heat-radiating chamber and also certain specified types of handles. It will be understood that single-door stoves, with a single door on the heat-radiating chamber may also be used, and if desired, doors may under certain circumstances be left off all together, particularly on the heat-radiating chamber.

The damper 90 has been defined as a barometric damper, which is known in the art. However, it is to be understood that this damper is of any type which will allow for appropriate cooling air to enter automatically into the fuel pipe. In fact, the invention is even more broad in that any means suitable to allow sufficient cool air enter the flue pipe on the other side of the intake from the combustion chamber from the direction in which the gases flow will be suitable. It is not intended that this be limited to a particular damper or other device, but the barometric damper is deemed most effective, and, in some cases, might be critical.

While the embodiments of this invention, shown and described, are fully capable of achieving the objects and advantages desired, it is to be understood that these embodiments are for purposes of illustration, and not for purposes of limitation.

We claim:

1. In a wood burning stove, the combination with a primary combustion chamber lined with brick, having some of the bricks vertically disposed within the said primary combustion chamber and held in position with clips, clipping alternate pairs of said bricks in position; of a secondary combustion chamber having baffle means therein for recirculation therein; and a flue pipe interconnected to said secondary chamber and extending outside of said stove with an upward and downward connection attached thereto, wherein the downward connection is provided with an opening suitable to draw cool air into the upward connection and having a flue portion containing a barometric damper located at right angles to said downward connection and communicating with said opening, said secondary combustion chamber being elevated from the primary chamber; and a heat radiating compartment located above the primary combustion chamber and depending into the secondary combustion chamber, said heat radiating compartment being provided with doors so that it may be used as an oven.

2. The combination of claim 1, wherein the said stove is provided with means to adjust the flow of air into the combustion chambers.

3. The combination of claim 2 wherein the primary combustion chamber is provided with an outwardly depending ledge adjacent an opening thereto for catching ashes and the like.

* * * * *